US010026352B2

(12) United States Patent
Miao et al.

(10) Patent No.: US 10,026,352 B2
(45) Date of Patent: Jul. 17, 2018

(54) METHOD FOR CONTROLLING A DISPLAY PANEL, A CIRCUIT OF CONTROLLING A DISPLAY PANEL AND A DISPLAY APPARATUS

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Jinghua Miao, Beijing (CN); Mubing Li, Beijing (CN); Pengcheng Lu, Beijing (CN); Xiaochuan Chen, Beijing (CN); Chung-Chun Chen, Beijing (CN); Xue Dong, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 69 days.

(21) Appl. No.: 15/228,574

(22) Filed: Aug. 4, 2016

(65) Prior Publication Data

US 2017/0116910 A1 Apr. 27, 2017

(30) Foreign Application Priority Data

Oct. 27, 2015 (CN) ..... 2015 1 0707426

(51) Int. Cl.
*G09G 3/20* (2006.01)
*G09G 3/36* (2006.01)

(52) U.S. Cl.
CPC ..... *G09G 3/2092* (2013.01); *G09G 3/36* (2013.01); *G09G 2300/0804* (2013.01)

(58) Field of Classification Search
CPC . G09G 3/2092; G09G 3/36; G09G 2300/0804
See application file for complete search history.

(56) References Cited

U.S. PATENT DOCUMENTS 6,333,729 B1 * 12/2001 Ha ..... G09G 3/3688 345/100
7,705,840 B2 4/2010 Wei et al.
(Continued)

FOREIGN PATENT DOCUMENTS

CN 101487962 A 7/2009
CN 102243838 A 11/2011
(Continued)

OTHER PUBLICATIONS

First Chinese Office Action, for Chinese Patent Application No. 201510707426.5, dated Mar. 21, 2017, 19 pages.
(Continued)

*Primary Examiner* — Nicholas Lee
*Assistant Examiner* — Robert Stone
(74) *Attorney, Agent, or Firm* — Kinney & Lange, P.A.

(57) ABSTRACT

The application provides a method for controlling a display panel, a circuit of controlling a display panel and a display apparatus. The method comprise: classifying sub sets of sub pixels in a same row according to an arrangement of the gate lines, the sets of sub pixels and the multiplexers of the display panel; for each received frame of original image data, inserting gate control data according to different types of the sub sets of sub pixels, wherein a gate control data is inserted preceding the image displaying data corresponding to each sub set of sub pixels, for the image displaying data corresponding to the $n^{th}$ row of sub pixels in each frame of the original image data, so as to generate sets of control and display data. The source driving circuit can apply signals corresponding to the data from the generated sets of control and display data to the corresponding multiplexers by using
(Continued)

a time sharing method, based on the generated set of control and display data, so as to perform the displaying.

8 Claims, 10 Drawing Sheets

(56) References Cited

U.S. PATENT DOCUMENTS

2006/0238134 A1* 10/2006 Park ..... G09G 3/3241 315/169.3
2009/0085858 A1* 4/2009 Hsu ..... G09G 3/3688 345/100
2009/0174649 A1* 7/2009 Kim ..... G09G 3/3688 345/104
2010/0002180 A1 1/2010 Kim et al.
2010/0182333 A1* 7/2010 Chiang ..... G09G 3/36 345/589
2010/0238148 A1* 9/2010 Sah ..... G09G 3/36 345/206
2011/0050671 A1* 3/2011 Sah ..... G09G 3/3651 345/211
2015/0248855 A1* 9/2015 Kim, II ..... G09G 3/2074 345/590
2017/0061853 A1* 3/2017 Yang ..... G02F 1/1362
2017/0069280 A1* 3/2017 Xu ..... G09G 3/20
2017/0269416 A1* 9/2017 Miao ..... G02F 1/13338

FOREIGN PATENT DOCUMENTS

CN 104751766 A 7/2015
WO WO2016161776 * 10/2016 ..... G09G 3/20

OTHER PUBLICATIONS

Chinese Rejection Decision, for Chinese Patent Application No. 201510707426.5, dated Aug. 16, 2017, 19 pages.
Second Chinese Office Action, for Chinese Patent Application No. 201510707426.5, dated May 11, 2017.

* cited by examiner

| | | | | | | | | | | | |
|---|---|---|---|---|---|---|---|---|---|---|---|
| r | g | b | r | g | b | r | g | b | r | g | b |
| r | g | b | r | g | b | r | g | b | r | g | b |
| r | g | b | r | g | b | r | g | b | r | g | b |
| r | g | b | r | g | b | r | g | b | r | g | b |
| r | g | b | r | g | b | r | g | b | r | g | b |
| r | g | b | r | g | b | r | g | b | r | g | b |

Fig. 4a

| | | | | | | | | | | | | | | | | | |
|---|---|---|---|---|---|---|---|---|---|---|---|---|---|---|---|---|---|
| **vgh** | r | g | vgl | b | r | vgl | g | b | vgl | r | g | vgl | b | r | vgl | g | b |
| vgl | r | g | **vgh** | b | r | vgl | g | b | vgl | r | g | vgl | b | r | vgl | g | b |
| vgl | r | g | vgl | b | r | **vgh** | g | b | vgl | r | g | vgl | b | r | vgl | g | b |
| vgl | r | g | vgl | b | r | vgl | g | b | **vgh** | r | g | vgl | b | r | vgl | g | b |
| vgl | r | g | vgl | b | r | vgl | g | b | vgl | r | g | **vgh** | b | r | vgl | g | b |
| vgl | r | g | vgl | b | r | vgl | g | b | vgl | r | g | vgl | b | r | **vgh** | g | b |

Fig. 4b

METHOD FOR CONTROLLING A DISPLAY PANEL, A CIRCUIT OF CONTROLLING A DISPLAY PANEL AND A DISPLAY APPARATUS

TECHNICAL FIELD

The present application relates to a field of display technology, in particular, to a method for controlling a display panel, a circuit of controlling a display panel and a display apparatus.

BACKGROUND

In a conventional display panel, a source driving circuit can receive an image data, cache the received image data, perform a digital-to-analog (D/A) conversion to the data, and transfer a converted signal to data lines of the display panel via a buffer. Additionally, a gate driving circuit may perform a progressive scanning. In particular, the gate driving circuit may generate a gate scanning signal which can turn on the gate lines progressively for timing control, and load the gate scanning signal for each row to a corresponding gate line so as to control to turn on pixel switches. Thus, the image data can be written into a storage capacitor of the row, so as to display images.

A configuration of the conventional display panel is shown in FIG. 1. In particular, the source driving circuit 1 may be set above or under the display panel, and the source driving circuit 1 as shown in FIG. 1 is provided above the display panel. Furthermore, a gate driving circuit 2 may be set on the left or the right of the display panel, in particular, the gate driving circuit 2 as shown in FIG. 1 is provided on the left of the display panel. In this manner, data lines and gate lines which are perpendicular with each other may be arranged on a display area of the display panel. Since the source driving circuit 1 and the gate driving circuit 2 may occupy periphery area of the display panel, the periphery area of the display panel may be enlarged, which may deteriorate a displaying effect of the display panel.

SUMMARY

Embodiments of the present disclosure provide a method for controlling a display panel, a circuit of controlling a display panel and a display apparatus, which can provide a method for controlling a no border display.

Therefore, the embodiments of the present disclosure may provide a method for controlling a display panel, the display panel may comprise a plurality of sub pixels arranged in an array, N gate lines connected to each row of sub pixels respectively, data lines connected to each column of sub pixels and a plurality of multiplexers connected to N gate lines one by one, wherein m columns of neighboring sub pixels are grouped into a set of sub pixels, each of the plurality of multiplexers is connected to one set of sub pixels via the data lines, and different multiplexers are connected to different sets of sub pixels, wherein N and m are both integers greater than 0, wherein:

each row of sub pixels in each set of sub pixels is considered as a sub set of sub pixels, the sub sets of sub pixels in each row are classified to a first-type sub set of sub pixels and a plurality of second-type sub set of sub pixels, wherein in the $n^{th}$ row of sub pixels, the first-type sub set of sub pixels is a sub set of sub pixels connected to the multiplexer which is connected with the $n^{th}$ gate line, and the second-type sub sets of sub pixels are other sub sets of sub pixels other than the first-type sub set of sub pixels in the $n^{th}$ row of sub pixels, wherein n is an integer and $1<n\leq N$; and the method may comprise:

receiving an original image data, wherein each frame of the original image data comprises image displaying data corresponding to the plurality of sub pixels;

inserting a gate control data preceding the image displaying data corresponding to each sub set of sub pixels, for the image displaying data corresponding to the $n^{th}$ row of sub pixels in each frame of the original image data, so as to generate sets of control and display data which corresponds to each of the sub sets of sub pixels respectively; wherein the gate control data inserted preceding the image displaying data corresponding to the first-type sub set of sub pixels is used for turning-on the gate, and the gate control data inserted preceding the image displaying data corresponding to the second-type sub sets of sub pixels is used for turning-off the gate; and outputting a signal corresponding to a set of data from a corresponding set of control and display data to each of the multiplexers corresponding to the sub sets of sub pixels simultaneously in a same period, according to the sets of control and display data corresponding to the sub sets of sub pixels in the $n^{th}$ row of sub pixels, upon displaying the $n^{th}$ row of sub pixels by a source driving circuit; and outputting the signal corresponding to the set of data from the corresponding set of control and display data to each of the multiplexers sequentially according to an arrangement of data from the sets of control and display data.

Preferably, the $n^{th}$ set of sub pixels along an extension direction of the gate lines and the $n^{th}$ gate line in the display panel may correspond to a same one multiplexer; and in the $n^{th}$ row of sub pixels, the $n^{th}$ sub set of sub pixels along an extension direction of the gate line is classified to the first-type sub set of sub pixels.

The embodiments of the present disclosure may also provide a circuit of controlling a display panel, the display panel comprises a plurality of sub pixels arranged in an array, N gate lines connected to each row of sub pixels respectively, data lines connected to each column of sub pixels and a plurality of multiplexers connected to N gate lines one by one, wherein m columns of neighboring sub pixels are grouped into a set of sub pixels, each of the plurality of multiplexers is connected to one set of sub pixels via the data lines, and different multiplexers are connected to different sets of sub pixels, wherein N and m are both integers greater than 0, wherein:

each row of sub pixels in each set of sub pixels is considered as a sub set of sub pixels, the sub sets of sub pixels in each row are classified to a first-type sub set of sub pixels and a plurality of second-type sub set of sub pixels, wherein in the $n^{th}$ row of sub pixels, the first-type sub set of sub pixels is a sub set of sub pixels connected to the multiplexer which is connected with the $n^{th}$ gate line, and the second-type sub sets of sub pixels are other sub sets of sub pixels other than the first-type sub set of sub pixels in the $n^{th}$ row of sub pixels, wherein n is an integer and $1<n\leq N$;

the circuit may comprises:

a data processing unit, configured to receive an original image data, wherein each frame of the original image data comprises image displaying data corresponding to the plurality of sub pixels; and to insert a gate control data preceding the image displaying data corresponding to each sub set of sub pixels, for the image displaying data corresponding to the $n^{th}$ row of sub pixels in each frame of the original image data, so as to generate sets of control and display data which corresponds to each of the sub sets of sub pixels respectively; wherein the gate control data inserted preceding the image displaying data corresponding to the first-type sub set of sub pixels is used for turning-on the gate, and the gate control data inserted preceding the image displaying data corresponding to the second-type sub sets of sub pixels is used for turning-off of the gate; and a source driving circuit, configured to output a signal corresponding to a set of data from a corresponding set of control and display data to each of the multiplexers corresponding to the sub sets of sub pixels simultaneously in a same period, according to the sets of control and display data corresponding to the sub sets of sub pixels in the $n^{th}$ row of sub pixels, upon controlling the displaying of the $n^{th}$ row of sub pixels; wherein the signal corresponding to the set of data from the corresponding set of control and display data is outputted to each of the multiplexers sequentially according to an arrangement of data from the sets of control and display data.

Preferably, the $n^{th}$ set of sub pixels along an extension direction of the gate lines and the $n^{th}$ gate line in the display panel correspond to a same multiplexer; and in the $n^{th}$ row of sub pixels, the $n^{th}$ sub set of sub pixels along an extension direction of the gate line is classified to the first-type sub set of sub pixels.

Accordingly, the embodiments of the disclosure may also provide a display apparatus, comprising a display panel which comprises a plurality of sub pixels arranged in an array, N gate lines connected to each row of sub pixels respectively, data lines connected to each column of sub pixels and a plurality of multiplexers connected to N gate lines one by one, wherein m columns of neighboring sub pixels are grouped into a set of sub pixels, each of the plurality of multiplexers is connected to one set of sub pixels via the data lines, and different multiplexers are connected to different sets of sub pixels, wherein N and m are both integers greater than 0, wherein: each row of sub pixels in each set of sub pixels is considered as a sub set of sub pixels, the sub sets of sub pixels in each row are classified to a first-type sub set of sub pixels and a plurality of second-type sub set of sub pixels, wherein in the $n^{th}$ row of sub pixels, the first-type sub set of sub pixels is a sub set of sub pixels connected to the multiplexer which is connected with the $n^{th}$ gate line, and the second-type sub sets of sub pixels are other sub sets of sub pixels other than the first-type sub set of sub pixels in the $n^{th}$ row of sub pixels, and the display apparatus may further comprise the circuit of controlling a display panel according to the embodiments of the disclosure, wherein n is an integer and $1<n\leq N$.

Preferably, the plurality of multiplexers may be placed on a periphery area on the display panel which is pointed by an extension direction of the data lines.

Preferably, the display apparatus may be a liquid crystal display panel.

BRIEF DESCRIPTION OF THE DRAWINGS

FIG. 4*a* is a data distribution diagram of image displaying data corresponding to the display panel shown in FIG. 3*a;*

FIG. 4*b* is a data distribution diagram after inserting a gate control data preceding the image displaying data shown in 4*a;*

DETAILED DESCRIPTION

Figure 1:
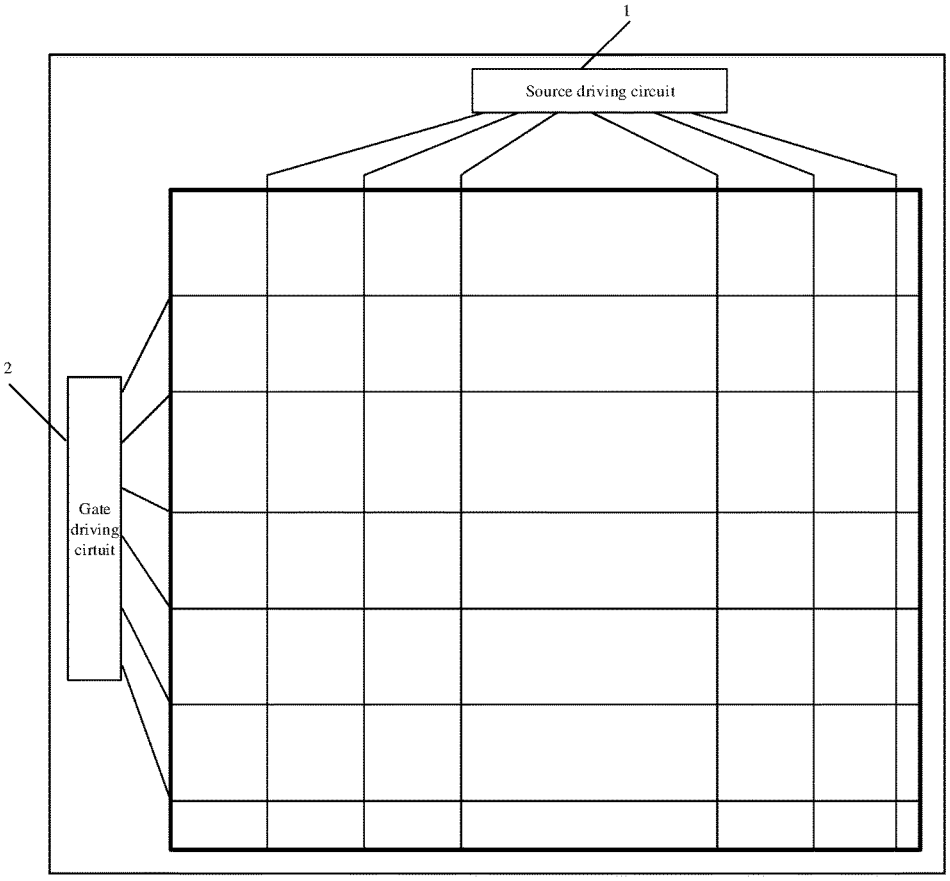
FIG. 1 is a schematic diagram illustrating a conventional display panel.
Figure 2A:
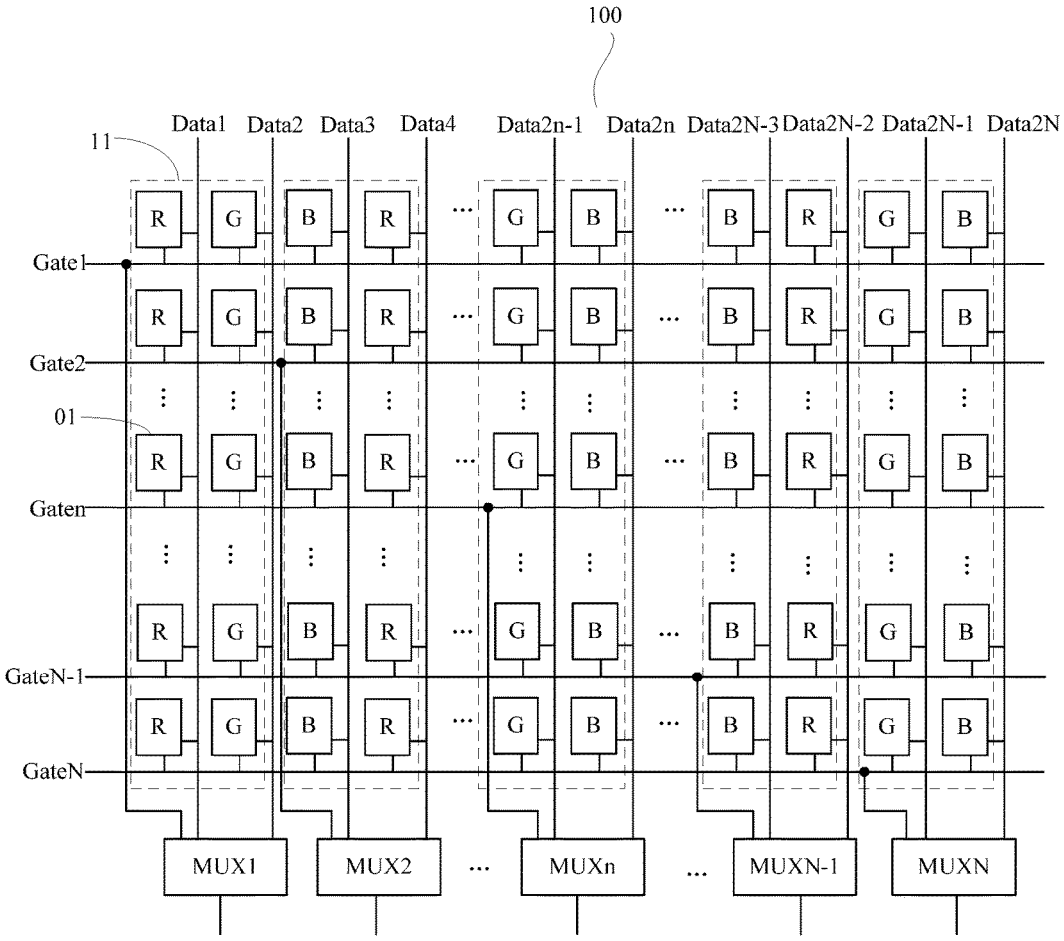
FIG. 2*a* is a schematic diagram illustrating a conventional border free display panel.

Embodiments of the present disclosure may provide a display panel without a separate gate driving circuit, which can integrate functions of the gate driving circuit into a source driving circuit and perform the functions by using a plurality of multiplexers. As shown in FIG. 2*a*, the display panel according to the embodiments of the present disclosure may comprise a plurality of sub pixels 01 arranged in an array, N gate lines (Gate1, Gate2, . . . , Gaten, . . . , GateN−1, GateN) connected to each row of sub pixels 01 respectively, data lines (Data1, Data2, . . . , Data2*n*, . . . , Data2N−1, Data2N) connected to each column of sub pixels 01 and a plurality of multiplexers (MUX1, MUX2, . . . , MUXn, . . . , MUXN−1, MUXN) connected to N gate lines (Gate1, Gate2, . . . , Gaten, . . . , GateN−1, GateN) one by one, wherein N is an integer greater than 0, and n is an integer and $1<n\leq N$. In FIG. 2*a*, two columns of neighboring sub pixels 01 are grouped into a set of sub pixels 11, each of the plurality of multiplexers is connected to one set of sub pixels 11 via the data lines, and different multiplexers are connected to different sets of sub pixels 11.

For each row of sub pixels 01, a time sharing method is performed. For example, for the $n^{th}$ row of sub pixels, a gate turning on signal is provided to the gate line Gaten corresponding to the $n^{th}$ row of sub pixels 01 through the multiplexer MUXn, and a gate turning off signal is provide to the gate lines corresponding to other rows of sub pixels 01 through the multiplexers other than MUXn, so as to ensure that the gate turning on signal is only provided to one gate line at a time. When a plurality of multiplexers (MUX1, MUX2, . . . , MUXn, . . . , MUXN−1, MUXN) output the gate turning on signal sequentially, since the gate turning on signal can be maintained on the gate line for a period, each of the plurality of multiplexers (MUX1, MUX2, . . . , MUXn, . . . , MUXN−1, MUXN) outputs data signal to the two columns of sub pixels 11 of a corresponding set of sub pixels 11 via the data lines during the period, which may result in displaying each row of sub pixels. In particular, FIG. 2*b* shows a corresponding timing diagram.

Figure 2B:
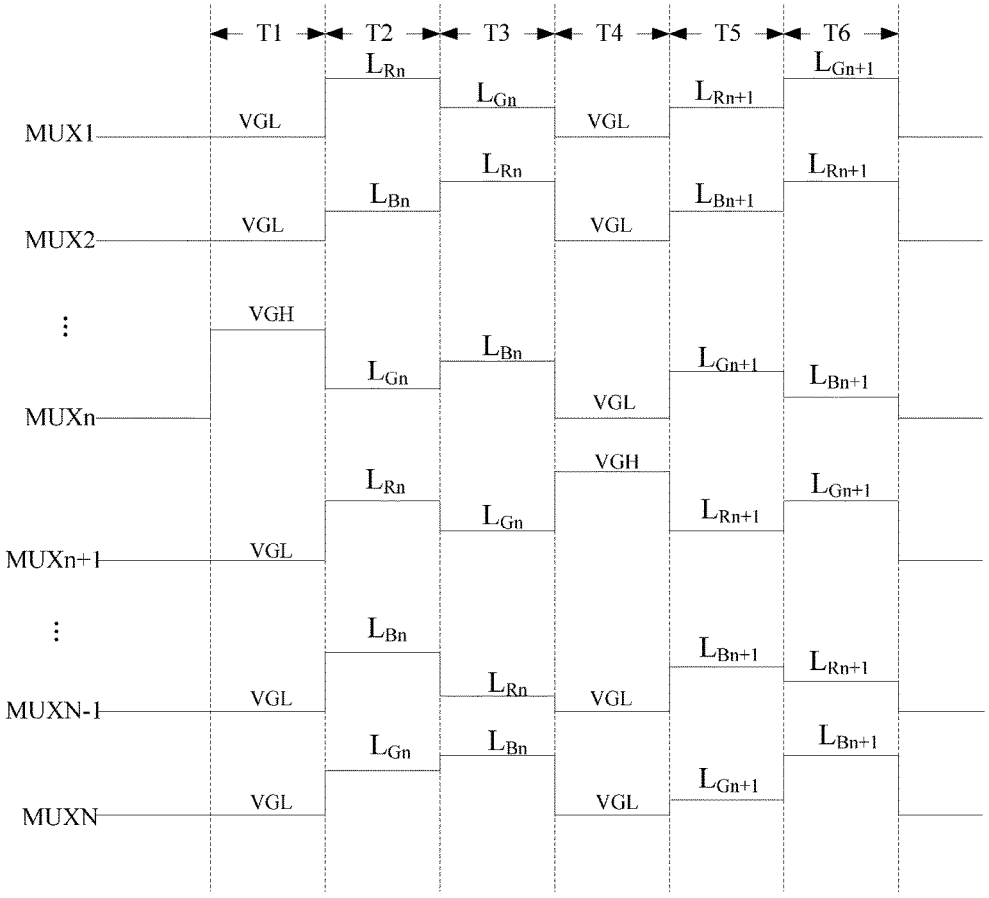
FIG. 2*b* is a timing diagram for the border free display panel shown in FIG. 2*a;*

As shown in FIG. 2*b*, taken the displaying of the $n^{th}$ row and the $n+1^{th}$ row of sub pixels as an example, in a first period T1, the multiplexer MUXn may provide the gate turning on signal VGH to the $n^{th}$ gate line Gaten, and other multiplexers except for the multiplexer MUXn may provide the gate turning off signal VGL to other gate lines. In a second period T2, the plurality of multiplexers (MUX1, MUX2, . . . , MUXn, . . . , MUXN−1, MUXN) may provide data signal ($L_{Rn}$, $L_{Bn}$, . . . , $L_{Gn}$, $L_{Rn}$, . . . , $L_{Bn}$, $L_{Gn}$) to the sub pixels arranged in odd columns respectively. In a third period T3, the plurality of multiplexers (MUX1, MUX2, . . . , MUXn, . . . , MUXN−1, MUXN) may provide data signal ($L_{Gn}$, $L_{Rn}$, . . . , $L_{Bn}$, $L_{Gn}$, . . . , $L_{Rn}$, $L_{Bn}$) to the sub pixels arranged in even columns respectively. This results in displaying the $n^{th}$ row of sub pixels. In a fourth period T4, the multiplexer MUXn+1 may provide the gate turning on signal VGH to the $n+1^{th}$ gate line Gaten+1, and other multiplexers may provide the gate turning off signal VGL to other gate lines. In a fifth period T5, the plurality of multiplexers (MUX1, MUX2, . . . , MUXn, . . . , MUXN−1, MUXN) may provide data signal ($L_{Rn+1}$, $L_{Bn+1}$, . . . , $L_{Gn+1}$, $L_{Rn+1}$, . . . , $L_{Bn+1}$, $L_{Gn+1}$) to the sub pixels arranged in odd columns respectively. In a sixth period T6, the plurality of multiplexers (MUX1, MUX2, . . . , MUXn, . . . , MUXN−1, MUXN) may provide data signal ($L_{Gn+1}$, $L_{Rn+1}$, . . . , $L_{Bn+1}$, $L_{Gn+1}$, . . . , $L_{Rn+1}$, $L_{Bn+1}$) to the sub pixels arranged in even columns respectively. This results in displaying the $n+1^{th}$ row of sub pixels.

However, in the display panel discussed above, the gate turning on signal and the gate turning off signal are both used to control the voltage at the gate line and have no relation with each frame of image displaying data. Thus, the display panel discussed above cannot generate the gate turning on signal and the gate turning off signal according to the received image displaying data directly.

Figure 3A:
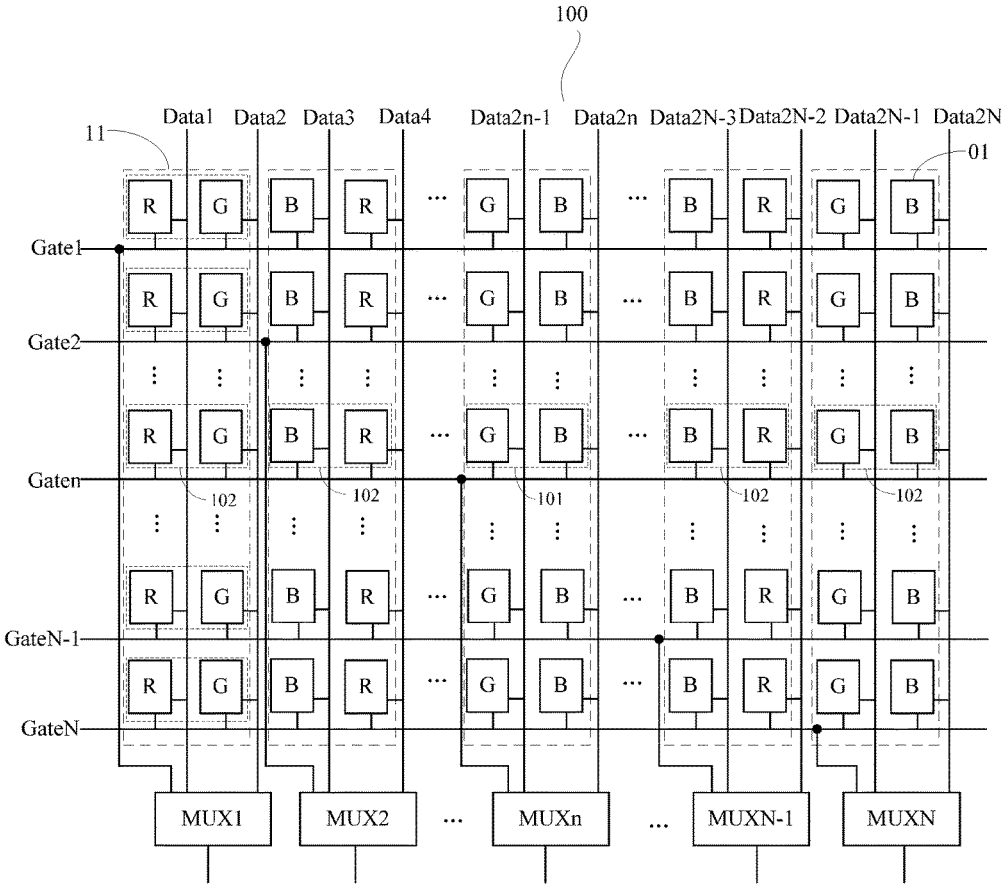
FIG. 3*a* is a schematic diagram illustrating a display panel according to embodiments of the present disclosure.

Accordingly, the embodiments of the present disclosure may provide a method for controlling a display panel. As shown in FIG. 3*a*, the display panel may comprise a plurality of sub pixels 01 arranged in an array, gate lines (Gate1, Gate2, . . . , Gaten, . . . , GateN−1, GateN) connected to each row of sub pixels 01, data lines (Data1, Data2, . . . , Data2*n*, . . . , Data2N−1, Data2N) connected to each column of sub pixels 01 and a plurality of multiplexers (MUX1, MUX2, . . . , MUXn, . . . , MUXN−1, MUXN) connected to gate lines (Gate1, Gate2, . . . , Gaten, . . . , GateN−1, GateN) one by one. In the display panel, N×m of neighboring sub pixels 01 may be grouped into a set of sub pixels 11 (in FIG. 3*a*, m=2). Each of the plurality of multiplexers may be connected to one set of sub pixels 11 via the data lines, and different multiplexers may be connected to different sets of sub pixels 11, wherein m is an integer greater than 0.

Furthermore, each row of sub pixels 01 in each set of sub pixels 11 may be considered as a sub set of sub pixels. The sub sets of sub pixels in each row may be classified to a first-type sub set of sub pixels 101 and a plurality of second-type sub set of sub pixels 102. In this manner, in the $n^{th}$ row of sub pixels 01, the first-type sub set of sub pixels 101 is a sub set of sub pixels connected to the multiplexer MUXn which is connected with the $n^{th}$ gate line MUXn, and the second-type sub sets of sub pixels 102 are other sub sets of sub pixels other than the first-type sub set of sub pixels 101 in the $n^{th}$ row of sub pixels 01.

Figure 3B:
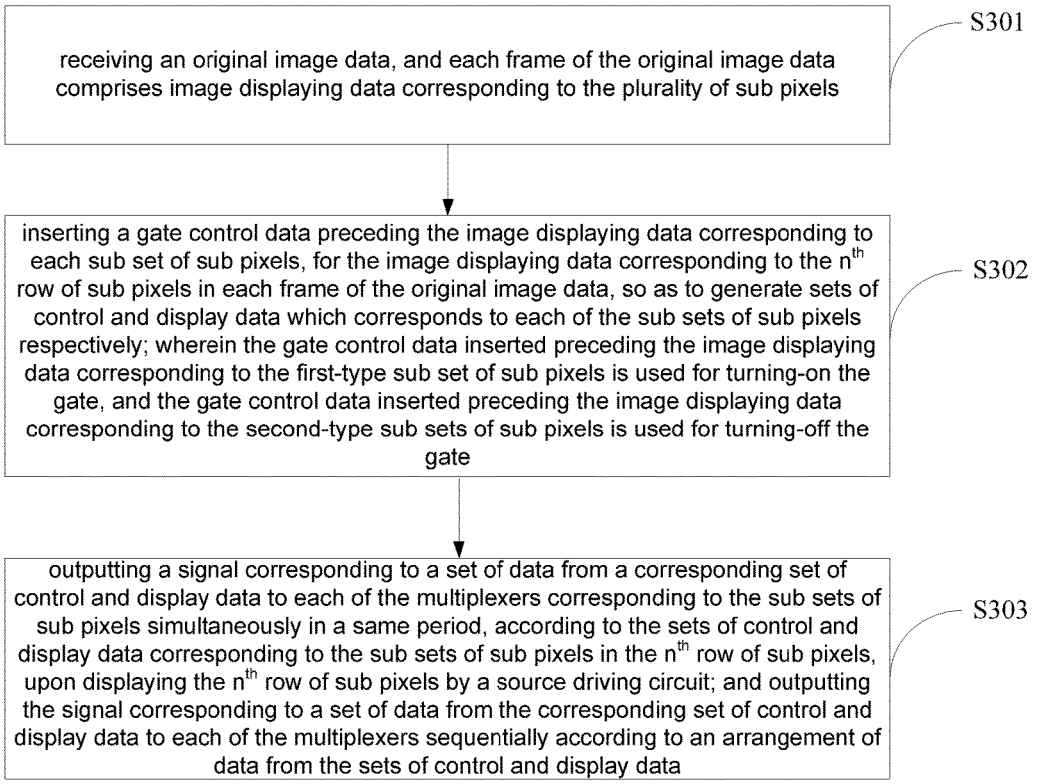
FIG. 3*b* is a flow chart illustrating a method for controlling the display panel according to the embodiments of the present disclosure.

As shown in FIG. 3*b*, the method for controlling the display panel according to the embodiments of the present disclosure may comprise:

in S301, receiving an original image data, wherein each frame of the original image data comprises image displaying data corresponding to the plurality of sub pixels;

in S302, inserting a gate control data preceding the image displaying data corresponding to each sub set of sub pixels, for the image displaying data corresponding to the $n^{th}$ row of sub pixels in each frame of the original image data, so as to generate sets of control and display data which corresponds to each of the sub sets of sub pixels respectively; wherein the gate control data inserted preceding the image displaying data corresponding to the first-type sub set of sub pixels is used for turning-on the gate, and the gate control data inserted preceding the image displaying data corresponding to the second-type sub sets of sub pixels is used for turning-off the gate; and in S303, outputting a signal corresponding to a set of data from a corresponding set of control and display data to each of the multiplexers corresponding to the sub sets of sub pixels simultaneously in a same period, according to the sets of control and display data corresponding to the sub sets of sub pixels in the $n^{th}$ row of sub pixels, upon displaying the $n^{th}$ row of sub pixels by a source driving circuit; and outputting the signal corresponding to a set of data from the corresponding set of control and display data to each of the multiplexers sequentially according to an arrangement of data from the sets of control and display data.

According to the method of the present disclosure, the sub sets of the sub pixels in a same row are classified according to the arrangement of the gate lines, the sets of sub pixels and the multiplexers of the display panel. For each received frame of the original image data, the inserting of the gate control data is performed according to different types of the sub sets of sub pixels. In particular, a gate control data is inserted preceding the image displaying data corresponding to each sub set of sub pixels, for the image displaying data corresponding to the $n^{th}$ row of sub pixels in each frame of the original image data, so as to generate sets of control and display data which corresponds to each of the sub sets of sub pixels respectively; wherein the gate control data inserted preceding the image displaying data corresponding to the first-type sub set of sub pixels is used for turning-on the gate, and the gate control data inserted preceding the image displaying data corresponding to the second-type sub sets of sub pixels is used for turning-off the gate. Therefore, the source driving circuit can apply signals corresponding to the data from the generated sets of control and display data which correspond to each of the sub sets of sub pixels respectively, to the corresponding multiplexers by using a time sharing method, according to the generated set of control and display data directly, so as to perform the displaying.

Furthermore, according to the method of the present disclosure, for the image displaying data corresponding to the $n^{th}$ row of sub pixels in each frame of the original image data, since the distribution of the inserted gate control data is related with the locations of the first type sub set of sub pixels and the second sub sets of sub pixels which may further relates to the arrangement of the gate lines, the sets of sub pixels and the multiplexers of the display panel, the distribution of the inserted gate control data inserted proceeding the image displaying data varies according to different arrangements of the gate lines, the sets of sub pixels and the multiplexers of the display panel. A detailed description will be discussed with reference to specific embodiments. It should be noted that the embodiments are intended to illustrate the present disclosure and not to limit it.

According to the method of the present disclosure, as shown in FIG. 3*a*, the $n^{th}$ set of sub pixels 11 along an extension direction of the gate lines and the $n^{th}$ gate line Gaten in the display panel may correspond to a same multiplexer MUXn. In the $n^{th}$ row of sub pixels 01, the $n^{th}$ sub set of sub pixels along an extension direction of the gate line Gaten is classified to the first-type sub set of sub pixels 101.

In particular, it is assumed that in a frame of the original image data corresponding to the display panel as shown in FIG. 3*a*, FIG. 4*a* is a data distribution diagram of image displaying data corresponding to sub sets of sub pixels, and FIG. 4*b* is a data distribution diagram after inserting a gate control data preceding the image displaying data shown in 4*a*, wherein VGH indicates the gate control data for turning on the gate, and VGL indicates the gate control data for turning off the gate.

It should be noted that according to the method of the present disclosure, the distribution of the gate control data only relates to the arrangement of the gate lines, the sets of sub pixels and the multiplexers in the display panel, but has no relation with the arrangement of the sub pixels in the display panel. In other words, as long as the arrangement of the gate lines, the sets of sub pixels and the multiplexers in the display panel is the same, the distribution of the gate control data will be the same, no matter what arrangement the sub pixels in the display panel is arranged in, for example, a RGB arrangement, a BV2 arrangement, a BV3 arrangement or a RGBW arrangement.

Based on the inventive concept, the embodiments of the present disclosure provides a circuit of controlling a display panel, wherein the display panel comprises a plurality of sub pixels arranged in an array, N gate lines connected to each row of sub pixels respectively, data lines connected to each column of sub pixels and a plurality of multiplexers connected to N gate lines one by one. In this manner, m columns of neighboring sub pixels are grouped into a set of sub pixels. Furthermore, each of the plurality of multiplexers is connected to one set of sub pixels via the data lines, and different multiplexers are connected to different sets of sub pixels, wherein N and m are both integers greater than 0. Additionally, each row of sub pixels in each set of sub pixels is considered as a sub set of sub pixels, and the sub sets of sub pixels in each row are classified to a first-type sub set of sub pixels and a plurality of second-type sub set of sub pixels. In the $n^{th}$ row of sub pixels, the first-type sub set of sub pixels is a sub set of sub pixels connected to the multiplexer which is connected with the $n^{th}$ gate line, and the second-type sub sets of sub pixels are other sub sets of sub pixels other than the first-type sub set of sub pixels in the $n^{th}$ row of sub pixels.

Figure 5:
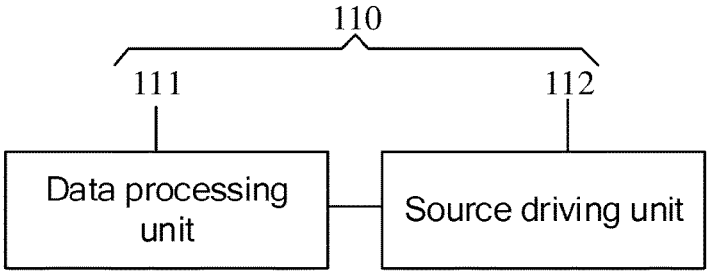
FIG. 5 is a schematic diagram illustrating a circuit of controlling a display panel according to the embodiments of the present disclosure.

As shown in FIG. 5, the circuit 110 may comprise:

a data processing unit 111, configured to receive an original image data, wherein each frame of the original image data comprises image displaying data corresponding to the plurality of sub pixels; and to insert a gate control data preceding the image displaying data corresponding to each sub set of sub pixels, for the image displaying data corresponding to the $n^{th}$ row of sub pixels in each frame of the original image data, so as to generate sets of control and display data which corresponds to each of the sub sets of sub pixels respectively; wherein the gate control data inserted preceding the image displaying data corresponding to the first-type sub set of sub pixels is used for turning-on the gate, and the gate control data inserted preceding the image displaying data corresponding to the second-type sub sets of sub pixels is used for turning-off of the gate; and a source driving circuit 112, configured to output a signal corresponding to a set of data from a corresponding set of control and display data to each of the multiplexers corresponding to the sub sets of sub pixels simultaneously in a same period, according to the sets of control and display data corresponding to the sub sets of sub pixels in the $n^{th}$ row of sub pixels, upon controlling the displaying of the $n^{th}$ row of sub pixels; wherein the signal corresponding to the set of data from the corresponding set of control and display data is outputted to each of the multiplexers sequentially according to an arrangement of data from the sets of control and display data.

According to the circuit of the present disclosure, the sub sets of the sub pixels in a same row are classified according to the arrangement of the gate lines, the sets of sub pixels and the multiplexers of the display panel. For each received frame of the original image data, the inserting of the gate control data is performed by the data processing unit 111 according to different types of the sub sets of sub pixels. In particular, a gate control data is inserted preceding the image displaying data corresponding to each sub set of sub pixels, for the image displaying data corresponding to the $n^{th}$ row of sub pixels in each frame of the original image data, so as to generate sets of control and display data which corresponds to each of the sub sets of sub pixels respectively; wherein the gate control data inserted preceding the image displaying data corresponding to the first-type sub set of sub pixels is used for turning-on the gate, and the gate control data inserted preceding the image displaying data corresponding to the second-type sub sets of sub pixels is used for turning-off the gate. Therefore, the source driving circuit can apply signals corresponding to the data from the generated sets of control and display data which correspond to each of the sub sets of sub pixels respectively, to the corresponding multiplexers by using a time sharing method, according to the generated set of control and display data directly, so as to perform the displaying.

According to the circuit of the present disclosure, the $n^{th}$ set of sub pixels along an extension direction of the gate lines and the $n^{th}$ gate line in the display panel correspond to a same multiplexer. In the $n^{th}$ row of sub pixels, the $n^{th}$ sub set of sub pixels along an extension direction of the gate line is classified to the first-type sub set of sub pixels.

Additionally, in the circuit according to the embodiments of the present disclosure, the data processing unit can be not only integrated into the source driving circuit, but can also be provided to be independent from the source driving circuit, which is not limited here.

Figure 6:
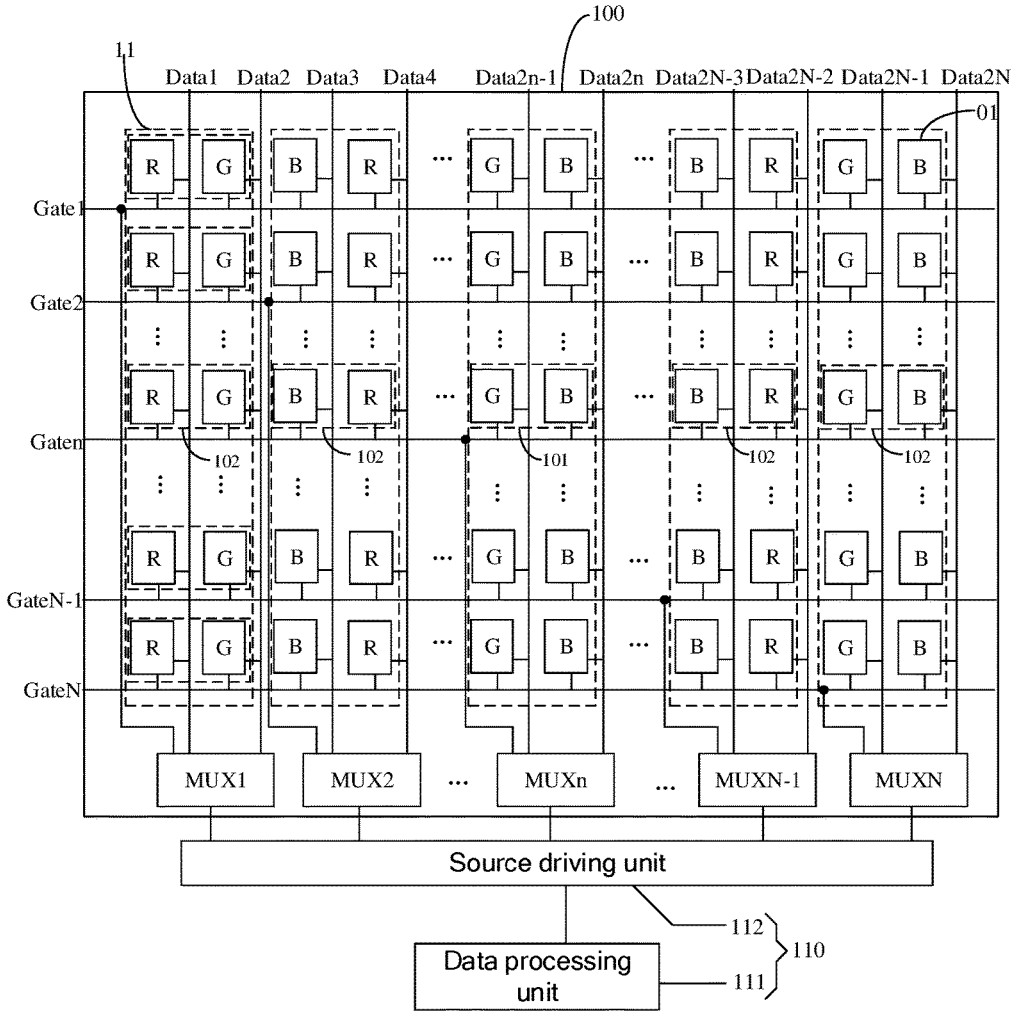
FIG. 6 is a schematic diagram illustrating a display apparatus according to the embodiments of the present disclosure.

Based on the same inventive concept, the embodiments of the present disclosure further provide a display apparatus as shown in FIG. 6, comprising a display panel 100 which comprises a plurality of sub pixels 01 arranged in an array, N gate lines (Gate1, Gate2, . . . , Gaten, . . . , GateN−1, GateN) connected to each row of sub pixels 01 respectively, data lines (Data1, Data2, . . . , Data2*n*, . . . , Data2N−1, Data2N) connected to each column of sub pixels 01 and a plurality of multiplexers (MUX1, MUX2, . . . , MUXn, . . . , MUXN−1, MUXN) connected to N gate lines (Gate1, Gate2, . . . , Gaten, . . . , GateN−1, GateN) one by one, wherein m columns of neighboring sub pixels 01 are grouped into a set of sub pixels 11 (in FIG. 6, m=2). Each of the plurality of multiplexers may be connected to one set of sub pixels 11 via the data lines, and different multiplexers may be connected to different sets of sub pixels 11, wherein N and m are integers greater than 0. Furthermore, each row of sub pixels 01 in each set of sub pixels 11 may be considered as a sub set of sub pixels. The sub sets of sub pixels in each row may be classified to a first-type sub set of sub pixels 101 and a plurality of second-type sub set of sub pixels 102. In this manner, in the $n^{th}$ row of sub pixels 01, the first-type sub set of sub pixels 101 is a sub set of sub pixels connected to the multiplexer MUXn which is connected with the $n^{th}$ gate line MUXn, and the second-type sub sets of sub pixels 102 are other sub sets of sub pixels other than the first-type sub set of sub pixels 101 in the $n^{th}$ row of sub pixels 01. The display apparatus may also comprise the circuit 110 according to the above embodiments of the present disclosure. Since the display apparatus and the circuit are based on the same inventive concept, the display apparatus may be implemented by referring to the above circuit, thus the description thereof will not be discussed.

In an implementation, the display apparatus maybe a liquid crystal display panel.

It should be noted that the display apparatus according to the embodiments of the disclosure may be a cell phone, a tablet, a TV, a display, a laptop, a digital frame, a navigator, and a product or a component having a displaying function, which is not limited here.

In an implementation, the plurality of multiplexers may be placed on a periphery of an area on the display panel which is pointed by an extension direction of the data lines.

Figure 7:
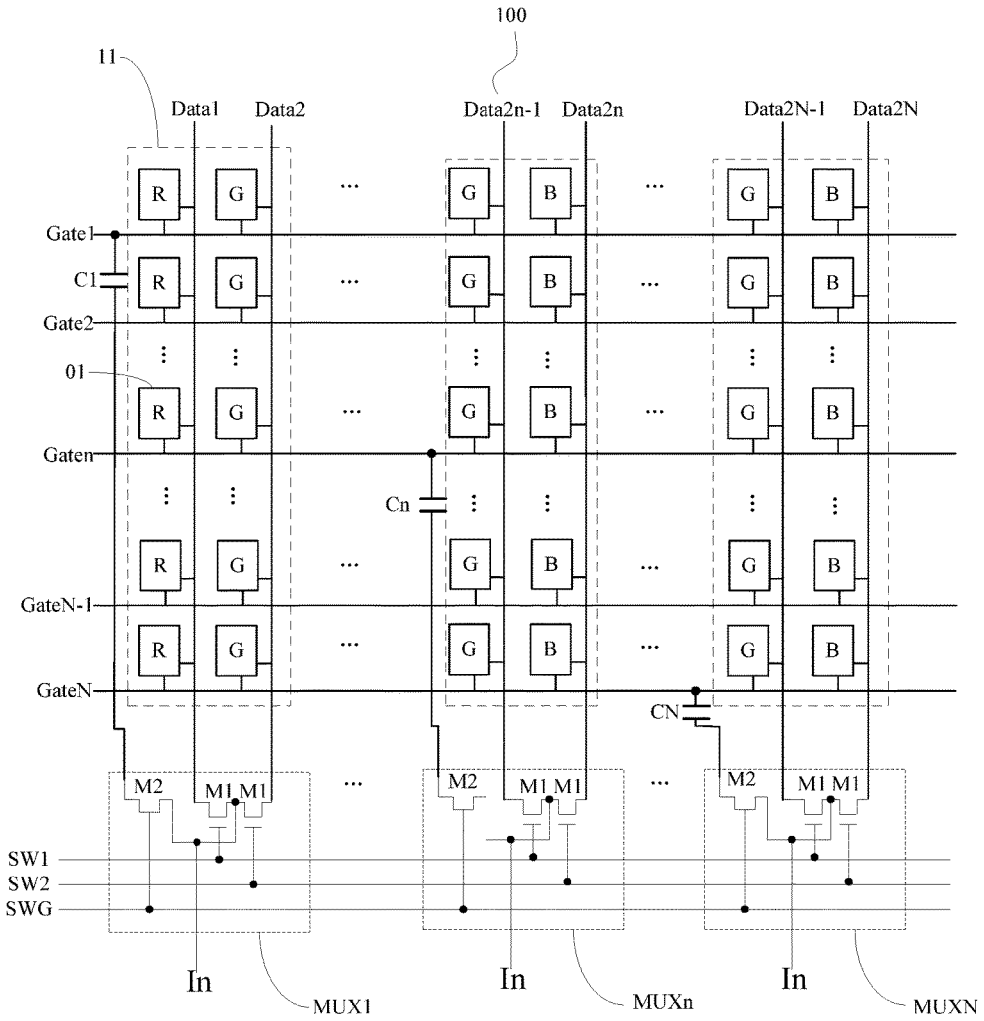
FIG. 7 is a detailed diagram illustrating a display panel comprised in the display apparatus according to the embodiments of the present disclosure.

Additionally, in the display apparatus of the present disclosure, as shown in FIG. 7 (wherein m=2), the multiplexer MUXn may comprise a first switch transistor M1 corresponding to data lines (Data2*n*−1 and Data2*n*); and a second switch transistor M2 corresponding to a gate line Gaten, wherein:

the first switch transistor M1 has a drain being connected to the data line Data2*n*−1 (Data2*n*), a source being connected to an input In of the multiplexer MUXn, a gate being configured to be used as a control of the multiplexer MUXn and connected to a data switch control line SW1 (SW2); and the second switch transistor M2 has a drain being connected to the gate line Gatan, a source being connected to the input In of the multiplexer MUXn, a gate being configured to be used as a control of the multiplexer MUXn and connected to a gate switch control line SWG;

Furthermore, in the display apparatus of the present disclosure, the multiplexer provides, the signal outputted by the source driving circuit which corresponds to the gate control data, to its corresponding gate line under the control of the gate switch control line. In order to keeping the signal being active until completing the charging of the sub pixels connected to the gate line, the display panel may also comprise a gate voltage storage capacitor Cn connected between the multiplexer MUXn and its corresponding gate Gaten in the display area, wherein the gate voltage storage capacitors may be independent from each other, shown in FIG. 7.

Figure 8:
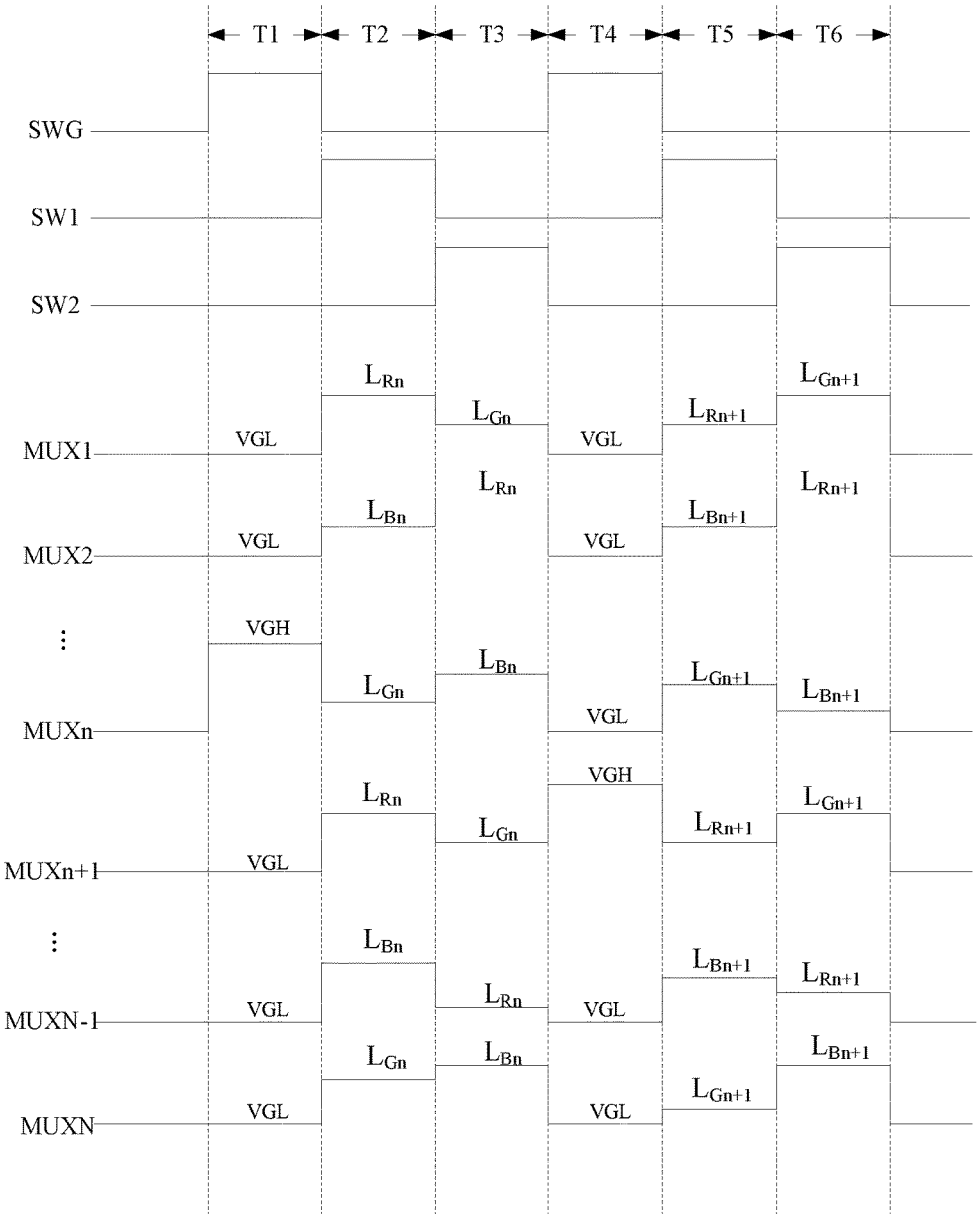
FIG. 8 is a timing diagram for driving the display panel shown in FIG. 7.

In particular, in the display apparatus of the present disclosure, when the structure of the multiplexer in the display panel is shown in FIG. 7, a corresponding timing diagram is shown in FIG. 8. In FIG. 8, taken the displaying of the $n^{th}$ row and the $n+1^{th}$ row of sub pixels as an example:

in a first period T1, the gate switch control line SWG may turn on the second switch transistor M2 of each multiplexer (MUX1, . . . , MUXn, . . . , MUXN). When the second switch transistor M2 being turned on, the gate turning on signal VGH is provided to the $n^{th}$ gate line Gaten by the multiplexer MUXn, and the gate turning off signal VGL is provided to other gate lines by other multiplexers except for the multiplexer MUXn;

in a second period T2, the data switch control line SW1 may turn on the first switch transistor M1 which is connected to the data line arranged in odd column in each multiplexer (MUX1, . . . , MUXn, MUXn+1, . . . , MUXN). Furthermore, when the first switch transistor M1 being turned on, the multiplexers (MUX1, . . . , MUXn, MUXn+1, . . . , MUXN) may provide data signal ($L_{Rn}$, $L_{Bn}$, . . . , $L_{Gn}$, $L_{Rn}$, . . . , $L_{Bn}$, $L_{Gn}$) to the sub pixels arranged in odd columns respectively;

in a third period T3, the data switch control line SW2 may turn on the first switch transistor M1 which is connected to the data line arranged in an even column in each multiplexer (MUX1, . . . , MUXn, MUXn+1, . . . , MUXN). Furthermore, when the first switch transistor M1 being turned on, the multiplexers (MUX1, MUX2, . . . , MUXn, . . . , MUXN−1, MUXN) may provide data signal ($L_{Gn}$, $L_{Rn}$, . . . , $L_{Bn}$, $L_{Gn}$, . . . , $L_{Rn}$, $L_{Bn}$) to the sub pixels arranged in even columns respectively, resulting in displaying the $n^{th}$ row of sub pixels;

in a fourth period T4, the gate switch control line SWG may turn on the second switch transistor M2 of each multiplexer (MUX1, . . . , MUXn, . . . , MUXN). When the second switch transistor M2 being turned on, the gate turning on signal VGH is provided to the $n+1^{th}$ gate line Gaten by the multiplexer MUXn+1, and a gate turning off signal VGL is provided to other gate lines by other multiplexers except for the multiplexer MUXn+1;

in a fifth period T5, the data switch control line SW1 may turn on the first switch transistor M1 which is connected to the data line arranged in odd column in each multiplexer (MUX1, . . . , MUXn, MUXn+1, . . . , MUXN). Furthermore, when the first switch transistor M1 being turned on, the multiplexers (MUX1, . . . , MUXn, MUXn+1, . . . , MUXN) may provide data signal ($L_{Rn+1}$, $L_{Bn+1}$, . . . , $L_{Gn+1}$, $L_{Rn+1}$, . . . , $L_{Bn+1}$, $L_{Gn+1}$) to the sub pixels arranged in odd columns respectively; and in a sixth period T6, the data switch control line SW2 may turn on the first switch transistor M1 which is connected to the data line arranged in an even column in each multiplexer (MUX1, . . . , MUXn, MUXn+1, . . . , MUXN). Furthermore, when the first switch transistor M1 being turned on, the multiplexers (MUX, MUX2, . . . , MUXn, . . . , MUXN−1, MUXN) may provide data signal ($L_{Gn+1}$, $L_{Rn+1}$, . . . , $L_{Bn+1}$, $L_{Gn+1}$, . . . , $L_{Rn+1}$, $L_{Bn+1}$) to the sub pixels arranged in even columns respectively, resulting in displaying the $n+1^{th}$ row of sub pixels.

Obviously, those skilled in the art can make various modifications and variations to the present disclosure without departing from the spirit and scope of the present disclosure. Thus, if these modifications and variations of the present disclosure belong to the scope of the claims of the present disclosure and the equivalent technologies thereof, the present disclosure is also intended to include these modifications and variations.

We claim:

1. A method for controlling a display panel, the display panel comprises a plurality of sub pixels arranged in an array, N gate lines connected to each row of sub pixels respectively, data lines connected to each column of sub pixels and a plurality of multiplexers connected to N gate lines one by one, wherein m columns of neighboring sub pixels are grouped into a set of sub pixels, each of the plurality of multiplexers is connected to one set of sub pixels via the data lines, and different multiplexers are connected to different sets of sub pixels, wherein N and m are both integers greater than 0, wherein:

each row of sub pixels in each set of sub pixels is considered as a sub set of sub pixels, the sub sets of sub pixels in each row are classified to a first-type sub set of sub pixels and a plurality of second-type sub set of sub pixels, wherein in the $n^{th}$ row of sub pixels, the first-type sub set of sub pixels is a sub set of sub pixels connected to the multiplexer which is connected with the $n^{th}$ gate line, and the second-type sub sets of sub pixels are other sub sets of sub pixels other than the first-type sub set of sub pixels in the $n^{th}$ row of sub pixels, wherein n is an integer and $1<n\leq N$;

the method comprising:

receiving an original image data, wherein each frame of the original image data comprises image displaying data corresponding to the plurality of sub pixels;

inserting a gate control data preceding the image displaying data corresponding to each sub set of sub pixels, for the image displaying data corresponding to the $n^{th}$ row of sub pixels in each frame of the original image data, so as to generate sets of control and display data which correspond to each of the sub sets of sub pixels respectively; wherein the gate control data inserted preceding the image displaying data corresponding to the first-type sub set of sub pixels is used for turning-on the gate line for the $n^{th}$ row of sub pixels, and the gate control data inserted preceding the image displaying data corresponding to the second-type sub sets of sub pixels is used for turning-off the gate line for the $n^{th}$ row of sub pixels; and outputting a signal corresponding to a set of data from a corresponding set of control and display data to each of the multiplexers corresponding to the sub sets of sub pixels simultaneously in a same period, according to the sets of control and display data corresponding to the sub sets of sub pixels in the $n^{th}$ row of sub pixels, upon displaying the $n^{th}$ row of sub pixels by a source driving circuit; and outputting the signal corresponding to the set of data from the corresponding set of control and display data to each of the multiplexers sequentially according to an arrangement of data from the sets of control and display data.

2. The method of claim 1, wherein the $n^{th}$ set of sub pixels along an extension direction of the gate lines and the $n^{th}$ gate line in the display panel correspond to a same multiplexer; and in the $n^{th}$ row of sub pixels, the $n^{th}$ sub set of sub pixels along an extension direction of the gate line is classified to the first-type sub set of sub pixels.

3. A circuit of controlling a display panel, the display panel comprises a plurality of sub pixels arranged in an array, N gate lines connected to each row of sub pixels respectively, data lines connected to each column of sub pixels and a plurality of multiplexers connected to N gate lines one by one, wherein m columns of neighboring sub pixels are grouped into a set of sub pixels, each of the plurality of multiplexers is connected to one set of sub pixels via the data lines, and different multiplexers are connected to different sets of sub pixels, wherein N and m are both integers greater than 0, wherein:

each row of sub pixels in each set of sub pixels is considered as a sub set of sub pixels, the sub sets of sub pixels in each row are classified to a first-type sub set of sub pixels and a plurality of second-type sub set of sub pixels, wherein in the $n^{th}$ row of sub pixels, the first-type sub set of sub pixels is a sub set of sub pixels connected to the multiplexer which is connected with the $n^{th}$ gate line, and the second-type sub sets of sub pixels are other sub sets of sub pixels other than the first-type sub set of sub pixels in the $n^{th}$ row of sub pixels, wherein n is an integer and $1<n\leq N$;

the circuit comprising:

a data processing unit, configured to receive an original image data, wherein each frame of the original image data comprises image displaying data corresponding to the plurality of sub pixels; and to insert a gate control data preceding the image displaying data corresponding to each sub set of sub pixels, for the image displaying data corresponding to the $n^{th}$ row of sub pixels in each frame of the original image data, so as to generate sets of control and display data which correspond to each of the sub sets of sub pixels respectively; wherein the gate control data inserted preceding the image displaying data corresponding to the first-type sub set of sub pixels is used for turning-on the gate line for the $n^{th}$ row of sub pixels, and the gate control data inserted preceding the image displaying data corresponding to the second-type sub sets of sub pixels is used for turning-off of the gate line for the $n^{th}$ row of sub pixels; and a source driving circuit, configured to output a signal corresponding to a set of data from a corresponding set of control and display data to each of the multiplexers corresponding to the sub sets of sub pixels simultaneously in a same period, according to the sets of control and display data corresponding to the sub sets of sub pixels in the $n^{th}$ row of sub pixels, upon controlling the displaying of the $n^{th}$ row of sub pixels; wherein the signal corresponding to the set of data from the corresponding set of control and display data is outputted to each of the multiplexers sequentially according to an arrangement of data from the sets of control and display data.

4. The circuit of claim 3, wherein the $n^{th}$ set of sub pixels along an extension direction of the gate lines and the $n^{th}$ gate line in the display panel correspond to a same multiplexer; and in the $n^{th}$ row of sub pixels, the $n^{th}$ sub set of sub pixels along an extension direction of the gate line is classified to the first-type sub set of sub pixels.

5. A display apparatus, comprising a display panel which comprises a plurality of sub pixels arranged in an array, N gate lines connected to each row of sub pixels respectively, data lines connected to each column of sub pixels and a plurality of multiplexers connected to N gate lines one by one, wherein m columns of neighboring sub pixels are grouped into a set of sub pixels, each of the plurality of multiplexers is connected to one set of sub pixels via the data lines, and different multiplexers are connected to different sets of sub pixels, wherein N and m are both integers greater than 0, wherein:

each row of sub pixels in each set of sub pixels is considered as a sub set of sub pixels, the sub sets of sub pixels in each row are classified to a first-type sub set of sub pixels and a plurality of second-type sub set of sub pixels, wherein in the $n^{th}$ row of sub pixels, the first-type sub set of sub pixels is a sub set of sub pixels connected to the multiplexer which is connected with the $n^{th}$ gate line, and the second-type sub sets of sub pixels are other sub sets of sub pixels other than the first-type sub set of sub pixels in the $n^{th}$ row of sub pixels, and the display apparatus further comprises the circuit of claim 3.

6. The display apparatus of claim 5, wherein the plurality of multiplexers are placed on a periphery of an area on the display panel which is pointed by an extension direction of the data lines.

7. The display apparatus of claim 5, wherein the display apparatus is a liquid crystal display panel.

8. The display apparatus of claim 6, wherein the display apparatus is a liquid crystal display panel.

* * * * *